United States Patent [19]

Vanderjagt

[11] Patent Number: 4,886,189

[45] Date of Patent: Dec. 12, 1989

[54] SYSTEM FOR SELECTIVELY CONTAINING METERING AND DISPENSING LIQUIDS

[76] Inventor: John A. Vanderjagt, 1395 Glen Oaks Dr., Memphis, Tenn. 38117

[21] Appl. No.: 229,715

[22] Filed: Aug. 8, 1988

Related U.S. Application Data

[63] Continuation-in-part of Ser. No. 161,769, Feb. 29, 1988, abandoned.

[51] Int. Cl.[4] ..... B67D 5/22

[52] U.S. Cl. ..... 222/49; 222/105; 222/333; 222/336; 222/386.5; 222/389; 222/390; 222/405

[58] Field of Search ..... 222/162, 386, 386.5, 222/319, 405, 326, 327, 160, 49, 50, 44, 47, 185, 333, 336, 389, 390, 105, 214; 92/98 D

[56] References Cited

U.S. PATENT DOCUMENTS

| | | | |
|---|---|---|---|
| 1,221,288 | 4/1917 | Canaday | 222/50 |
| 1,505,297 | 8/1924 | Stephenson | 222/336 |
| 2,198,666 | 4/1940 | Gruskin | 222/47 X |
| 2,471,852 | 5/1949 | Bau | 222/386.5 X |
| 2,655,289 | 10/1953 | Peal | 222/162 |
| 2,728,494 | 12/1955 | Hobson | 222/386.5 |
| 2,966,143 | 12/1960 | Panza | 92/98 D |
| 3,048,171 | 8/1962 | Grau | 222/386.5 X |
| 3,305,143 | 2/1967 | Frankenburg | 222/386.5 |
| 3,327,906 | 6/1967 | Gömann | 222/389 |
| 3,375,759 | 4/1968 | Smith | 92/98 D |
| 4,136,802 | 1/1979 | Mascia et al. | 222/386.5 X |
| 4,162,501 | 7/1979 | Mitchell et al. | 222/340 X |
| 4,165,024 | 8/1979 | Oswalt et al. | 222/105 |
| 4,381,006 | 4/1983 | Genese | 222/340 X |
| 4,432,473 | 2/1984 | MacEwen | 222/386.5 X |
| 4,635,820 | 1/1987 | Marshall | 222/333 X |
| 4,793,524 | 12/1988 | Starr | 222/333 X |

FOREIGN PATENT DOCUMENTS

| | | | |
|---|---|---|---|
| 461207 | 1/1951 | Italy | 222/326 |
| 136996 | 2/1930 | Switzerland | 222/326 |
| 1245356 | 9/1971 | United Kingdom | 92/98 D |
| 2153443 | 8/1985 | United Kingdom | 222/327 |

*Primary Examiner*—Jospeh J. Rolla
*Assistant Examiner*—Gregory L. Huson
*Attorney, Agent, or Firm*—Walker & McKenzie

[57] ABSTRACT

A system for selectively containing and dispensing liquids. The system has a container for the liquid with the container including a housing and a flexible diaphragm in the interior of the housing for holding the liquid. An actuator is coupled to the diaphram for moving the diaphragm between an extended position in which the diaphragm can hold more of the liquid and retracted positions in which the diaphragm holds less of the liquid than when in the extended position. A force transmitting unit is coupled to the actuator for causing the actuator to move the diaphragm in a direction from the extended position towards a completely retracted position to dispense the liquid from the container.

26 Claims, 6 Drawing Sheets

SYSTEM FOR SELECTIVELY CONTAINING METERING AND DISPENSING LIQUIDS

CROSS-REFERENCE TO RELATED APPLICATION

This is a continuation-in-part of my application, Ser. No. 161,769, filed 2/29/88 entitled "System for Selectively Containing, Metering, and Dispensing Liquid", now abandoned.

BACKGROUND OF THE INVENTION

1. Field of the Invention: The present invention relates to a system for selectively containing, metering and dispensing liquids.

2. Description of the Related Art: Heretofore, systems for containing and dispensing liquids, such as chemicals and the like, comprise in general a container for containing the liquid, a suction tube extending down in the interior of the container, a one way valve in the suction tube to allow the liquid to be drawn out of the container, but preventing any return of the liquid into the container, and sealing means to guard against unauthorized entry by the user into the container prior to return of the container to the company to be refilled. Thus, with returnable containers, as above described, the company could rest assured that the containers would not be returned contaminated. However, with the prior systems above described, for the user, such as a farmer using the chemicals to spray his crops, it was necessary for him to own a separate pump and measuring device for dispensing a measured amount of chemicals received from the suction tube of the container. Consequently, by having his own pump and measuring device, the danger to the user being exposed to the poisonous or hazardous chemicals or the like was increased, for example, during the cleaning of the pump and the metering device. A pending application for Returnable Container System was filed by me on Dec. 14, 1987, Ser. No. 132,176, which was directed toward providing improved returnable container systems for chemicals and the like which gives an option to the user to use the system in a first condition or a second condition.

SUMMARY OF THE INVENTION

The present invention is directed towards providing an improved system for selectively containing and dispensing liquids and which system, in general, has separable parts, namely a container for the liquid which includes a flexible diaphragm for holding the liquid and an actuator means coupled to the diaphragm for moving the diaphragm into an extended position in which the diaphragm can hold more of the liquid and retracted positions in which the diaphragm holds less of the liquid than when in the extended position. Since the actuator means and the container are separable, the container may be returned to the company for filling the container and the actuator means along with the associated parts can remain at the point of use such as at the farm where the liquid is to be used to spray crops and the like.

The concept of the present invention is to provide a simple yet effective system for containing liquid and for dispensing same, which system has a minimum of moving parts and is a closed system whereby the user need not be exposed to the liquids, as for example poisonous or hazardous chemicals and the like.

One of the objects of the present invention is to provide an improved system for selectively containing, metering and dispensing liquids, which is efficient and effective, and in which the users of the system will not become exposed to the liquids unnecessarily.

A further object is to provide such a system wherein means is provided for accurately measuring the amount of liquid dispensed from the system.

A further object is to provide such a system which comprises a container for the liquid, said container including a housing having an interior, and a flexible diaphragm in said interior of said housing for holding the liquid; actuator means coupled to said diaphragm for moving said diaphragm into an extended position in which said diaphragm can hold more of the liquid and retracted positions in which said diaphragm holds less of the liquid than when in said extended position; discharge means communicated with the interior of said housing for discharging the liquid held in said diaphragm to the exterior of said container, said discharge means including valve means for controlling the discharge of the liquid; and force transmitting means coupled to said actuator means for causing said actuator means to move said diaphragm in a direction from said extended position toward said retracted positions to dispense the liquid from said container and out said discharge means.

DESCRIPTION OF THE PREFERRED EMBODIMENT

Figure 1:
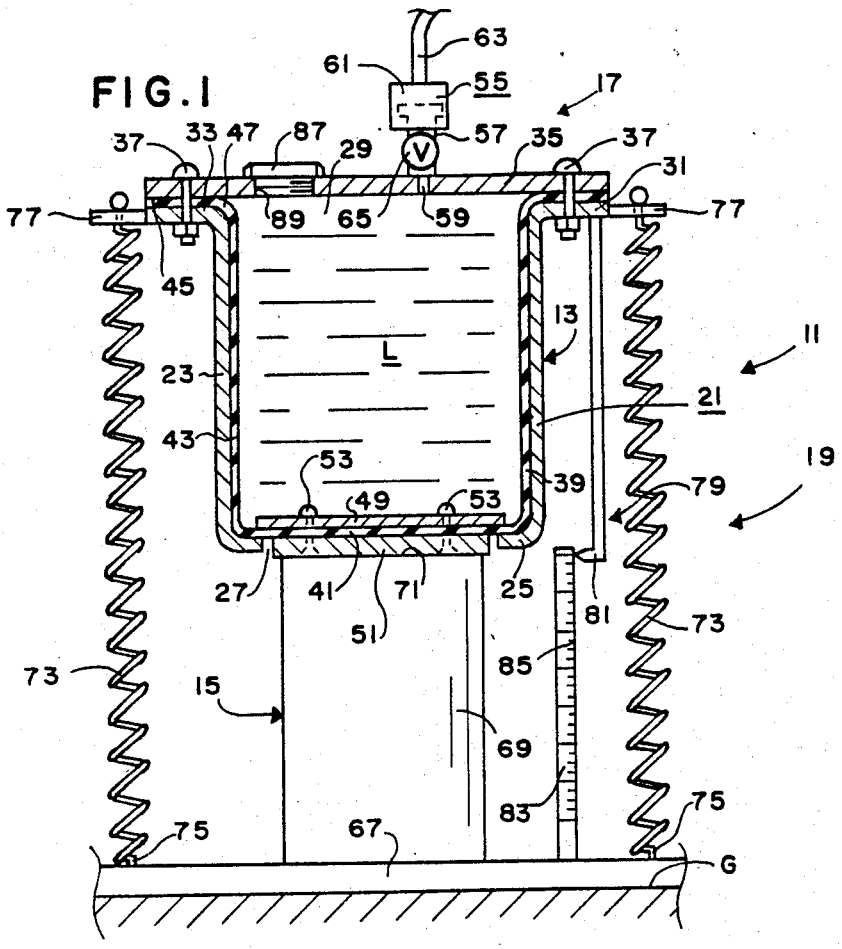
FIG. 1 is a partially sectionalized view along a vertical plane through the center of the system of the present invention, showing the parts thereof in an extended position.

The system 11 (see FIGS. 1 and 2) of the present invention includes, in general, a container 13 for the liquid L, actuator means 15, discharge means 17, and force transmitting means 19.

Container 13 includes a hollow cylindrical housing 21 having a cylindrical side wall 23 and a bottom or end 25 having the outer peripheral edge thereof preferably integrally attached to the lower edge of wall 23. End 25 has an opening 27, which is preferably circular with the center thereof preferably being along the center line of the housing 21. The top or opposite end of housing 21 is preferably open as at 29, that is, housing 21 preferably opens upwardly. Housing 21 includes a flange 31 at the upper edge 33 of wall 23 adjacent opening 29 and extending outwardly around the periphery of upper edge 33.

Container 13 also includes a disk like cover 35 removably mounted over open end 29 to close off the open end 29. Suitable means well known to those skilled in the art such as bolt and nut means 37 is provided for removably attaching cover 35 to flange 31.

In addition, container 13 includes a flexible diaphragm 39 in the interior of housing 21 for holding liquid L. Flexible diaphragm 39 is well known to those skilled in the art and is preferably of the so-called "rolling type" and which is formed of any suitable material such as rubber, plastic or the like.

Diaphragm 39 is shaped in a similar manner to housing 21, but has no opening in the bottom or end 41 thereof and is adapted to fit closely along the interior surface of housing 21. Thus, diaphragm 39 preferably includes a cylindrical side wall 43 which is preferably integrally joined along the lower edge thereof to the outer edge of bottom 41, and preferably includes a flange 45 preferably integrally attached adjacent the upper edge 47 of diaphragm side wall 43 and extends outwardly therefrom. Flange 45 is sandwiched between cover 35 and housing flange 31 to sealably prevent the escape of liquid from container 13. As is the case with housing 21, diaphragm 39 is open at the top or opposite end from end 41, and is removably closed by an end or cover 35. Diaphragm 39 is unattached to housing 31 except at the flanges 31, 45, which is by bolt and nut means 37.

Additionally, container 13 includes a first plate 49, which is preferably disk like and is disposed over the greater part of the end 41 of diaphragm 39, a second plate 51, which is also preferably disk like, is disposed on the underside or opposite side of diaphragm 39 from first plate 49 with the end 41 of diaphragm 39 being sandwiched between plates 49, 52, and means well known to those skilled in the art, such as rivets 53, fixedly join together plates 49,51 with the portion of end 41 therebetween and with this joint being sealed against leakage of liquid L from the container 13. Second plate 51 is of a smaller size than opening 27 whereby second plate 51 is adapted to freely extend into opening 27, as best seen in FIG. 1. First plate 49 is of a larger size than opening 27 whereby the end 25 of housing 21 is adapted to act as a stop to limit movement of plates 49, 51 and the sandwiched portion of end 41 of diaphragm 39, as best seen in FIG. 1, wherein diaphragm 39 is in an extended position in which container 13 can hold its greatest capacity of liquid L. It will be understood from the foregoing that the plates 49, 51 establish a movable portion of container 13 which is movable relative to the fixed portions of container 13, i.e., the wall 23, end 25, and cover 35, and that diaphragm 39 acts as a means for sealing the movable portion and the fixed portions of container 13 to permit movement of the movable portion and at the same time prevent liquid from escaping from between the movable portion and the fixed portion;

Discharge means 17 comprises quick coupling means 55 well known to those skilled in the art which includes a first part 57 fixedly attached to cover 35 as by welding or the like and which is in communication with the interior of housing 21 and diaphragm 39 through an aperture 59. Discharge means 17 also includes a second part 61 detachably connected to first part 57 and in communication with first part 57, and thereby in communication with the interior of housing 21 and diaphragm 39. In addition, discharge means 17 includes conduit means 63 coupled to second part 61 for conducting the dispensed liquid L to a place of use, and includes one way valve means 65 preferably interposed in part 57 for controlling the discharge of the liquid L.

Actuator means 15 is coupled to diaphragm 39 for moving diaphragm 39 from said extended position in which diaphragm 39 can hold more of the liquid, as a capacity as shown in FIG. 1, to retracted positions in which diaphragm 39 holds less of the liquid L than when in said extended position. Actuator means 15 includes a base plate 67 adapted to be supported from a suitable surface such as the ground G. Also, actuator means 15 includes a displacer or projection 69 attached to base plate 67 by suitable means as welding or the like and extends upwardly from the base plate 67. Projection 69 is sized in horizontal cross section to allow container 13 to move vertically relative to projection 69 between the extended position shown in FIG. 1 and a completely retracted position in which first plate 49 is adjacent cover 35 and the end 25 of container 13 is adjacent base plate 67. Projection 69 is preferably cylindrial in shape and is adapted to restingly receive second plate 51 on the upper end 71 of projection 69.

Figure 2:
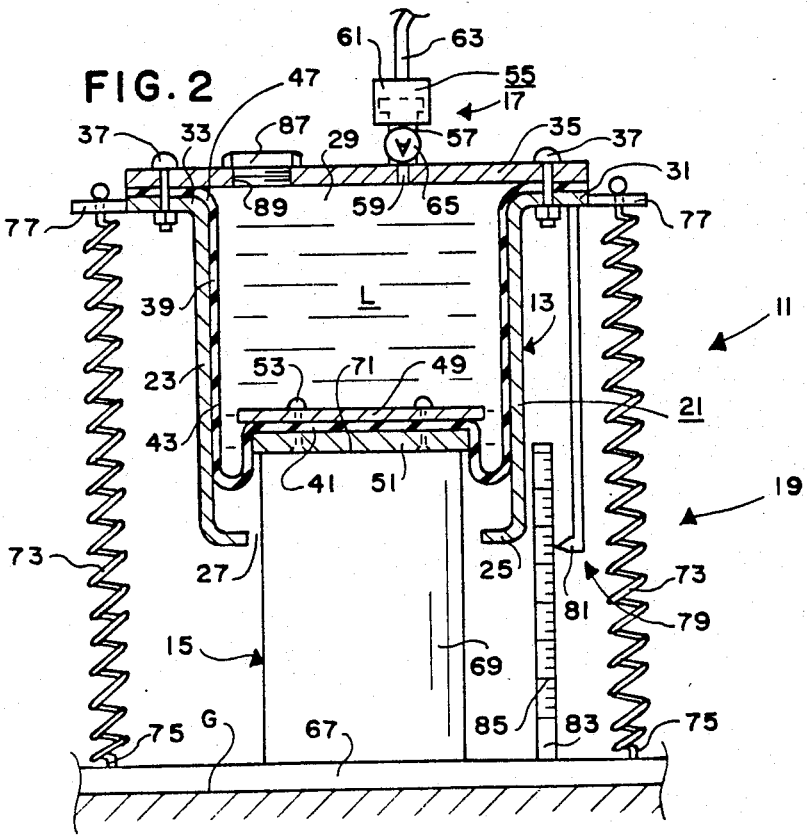
FIG. 2 is a view similar to FIG. 1, but showing the parts thereof in one of the retracted positions.
Figure 3:
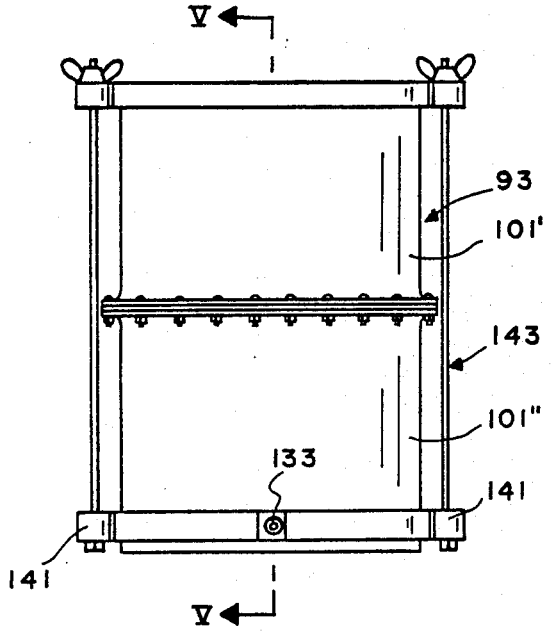
FIG. 3 is a side elevational view of the container of a second embodiment of the present invention in a shipping configuration.
Figure 4:
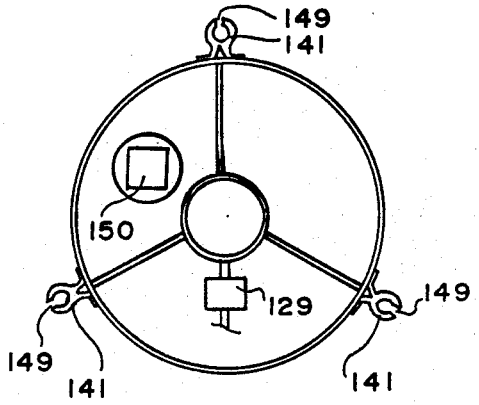
FIG. 4 is a bottom view of the container of said second embodiment shown with the top and tie rods removed.

It will be understood that when actuator means 15 is in a completely retracted position, that is, in a position opposite from the extended position shown in FIG. 1, in which first plate 49 is adjacent cover 35 and diaphragm 39 is in a completely retracted position, the diaphragm substantially completely empties the interior of housing 21. It will further be understood that said completely retracted position of diaphragm 39 and said completely retracted position of actuator means 15 and container 13 is not shown in the drawings, but an intermediate position between said extended and said completely retracted position is shown in FIG. 2. It will be noted that in moving from said extended position toward said retracted positions, diaphragm 39 "rolls" or doubles back upon itself, as best seen in FIG. 2. Also, it will be understood that in the drawing the spacing between the doubled back portions of diaphragm 39 has been exaggerated for purposes of illustration, but that in actual practice a minimum of spacing is preferable particularly if it is desired to substantially empty liquid L from container 13 when diaphragm 39 is in said completely retracted position.

Force transmitting means 19 is coupled to actuator means 15 for causing the actuator means to move the diaphragm means 19 in a direction from said extended position toward said completely retracted position to dispense liquid L from the container 13 and out discharge means 17. Force transmitting means 19 preferably includes biasing means which is in the form of any suitable well known force transmitting means well known to those skilled in the art, such as by air, vacuum, electric or hand powered. In the drawings, it is shown as a pair of tension springs 73.

The lower ends of spring 73 are preferably fixedly attached to base plate 67 by suitable means as at 75 and the upper ends of the tension spring 73 are respectively removably attached to flange 31 by suitable means, as brackets 77, which will not be apparent to those skilled in the art.

System 11 preferably includes suitable measuring means 79, which will not be apparent to those skilled in the art, for indicating the position of projection 69 and container 13 relative to one another. Measuring means 79 preferably includes a pointer 81 fixed relative to flange 31 by suitable means, now well known to those skilled in the art. Measuring means 79 also preferably includes a measuring stick 83 fixedly supported from base plate 67 and upstanding therefrom. Measuring stick 83 is provided with graduations 85 thereon for indicating the amount of liquid L in container 13.

A sealable bung 87 is preferably removably provided in a threaded bunghole 89 in cover 35, for filling container 13.

In the operation of the present invention, it is particularly useful to contain, transport and dispense liquids such as those used for spraying crops on a field of a farm. Thus, with container 13 and actuator means 15 detached from one another as by removing the upper ends of tension springs 73 from brackets 77, the container 13 may be filled by the chemical manufacturer at its plant. Then, with the valve means 65 closed off, the container 13 may be transported to the farm where the farmer who keeps the actuator means 15 at his farm, can then place the container 13 on top of the projection 69, attach the springs 73 to the brackets 77, and dispense the desired amount of chemicals through the conduit means 63 by opening the valve 65 the desired amount while monitoring the amount dispensed by means of the measuring means 79. After the container 13 is empty, the farmer can then return the empty container 13 to the chemical manufacturer for a refill and keep the actuator means 15 for subsequent use. Also, it will be apparent that the assembled empty unit with actuator means 15 in said completely retracted position may be shipped if desired in this compact disposition. As for example, it may be shipped by a manufacturer of such apparatus to the point of sale to the farmer who can then separate the actuator means 15 from the container 13 and have the container 13 filled by the chemical manufacturer.

A second embodiment of the system of the present invention is shown in FIGS. 3–10.

Referring first to FIGS. 3–9, the system 91 includes, in general, a container 93 for the liquid L, actuator means 95, discharge means 97, and force transmitting means 99.

Container 93 includes a hollow cylindrical housing 101 having a cylindrical side wall 103, an end 105 having the outer peripheral edge thereof preferably integrally attached to the upper edge of wall 103, and an end 107 spaced from end 105 having the outer peripheral edge thereof preferably integrally attached adjacent to lower edge 109 of wall 103. End 105 has an opening 111, which is preferably circular with the center thereof preferably being along the center line of the housing 101.

In addition, container 93 includes a flexible diaphragm 113 in the interior of housing 101. Flexible diaphragm 113 is well known to those skilled in the art and is preferably of the so-called "rolling type" and which is formed of any suitable material such as rubber, plastic or the like.

Rather than covering the entire interior of the wall 103, as in the embodiment of FIGS. 1 and 2, flexible diaphragm 113 in the system 91 preferably is adapted to fit closely along one-half the interior surface of wall 103 and housing 101 is preferably formed from two halves 101′ and 101″ which are joined together at the peripheral flanges 103′, 103″ provided at the adjacent edges of the halves 101′, 101″ and which are securely held together by the bolt and nut means 115 well known to those skilled in the art, and with the out-turned flange portions 117 of diaphragm 113 being sandwiched between the peripheral flanges 103′, 103″ to securely close off the joint from all leakage of liquid L in container 93. Diaphragm 113 is shaped in a similar manner to half of the housing 101 but has no opening in the end 119 thereof and is adapted to fit closely on the interior surface of one-half the housing 101. Thus, diaphragm 113 includes a cylindrical side wall 121 which is preferably integrally joined along the upper edge thereof to the outer edge of end 119. Diaphragm 113 is open at the bottom or opposite end from end 119. Diaphragm 113 is unattached to housing 101 except at the flanges 117, 102′ and 103″ which is by bolt and nut means 115.

Figure 5:
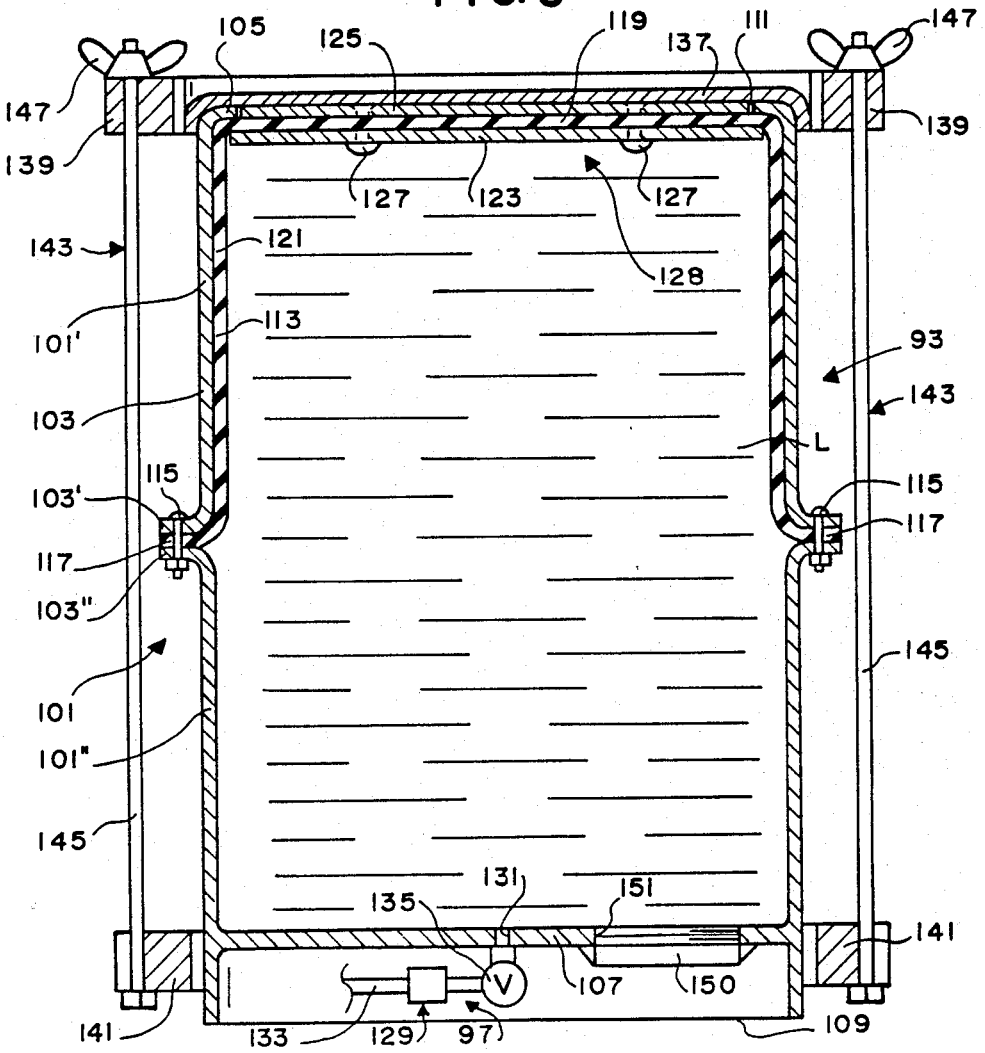
FIG. 5 is an enlarged sectional view taken as on the line V—V of FIG. 3.
Figure 6:
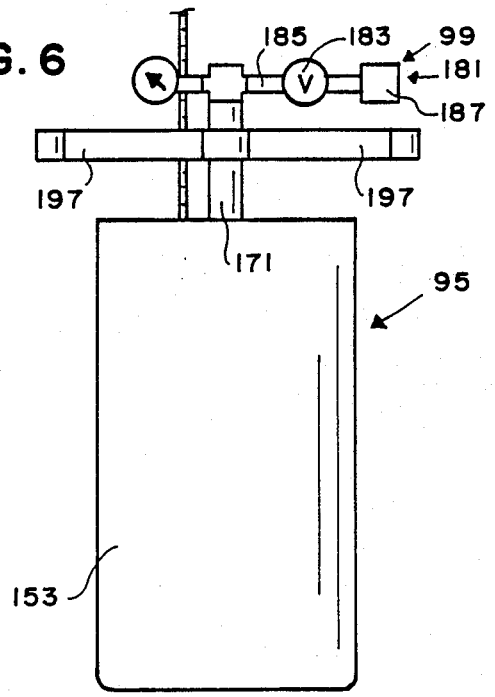
FIG. 6 is a side elevational view of the actuator of said second embodiment.
Figure 7:
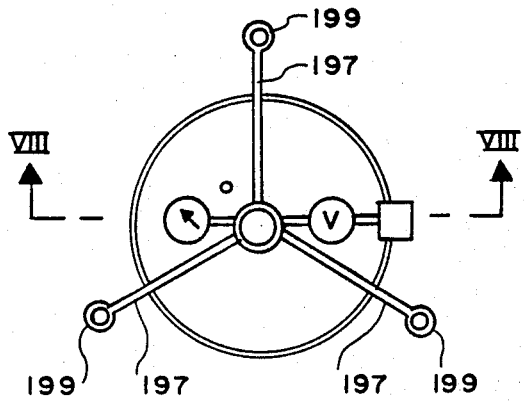
FIG. 7 is a top plan view of the actuator shown in FIG. 6.
Figure 8:
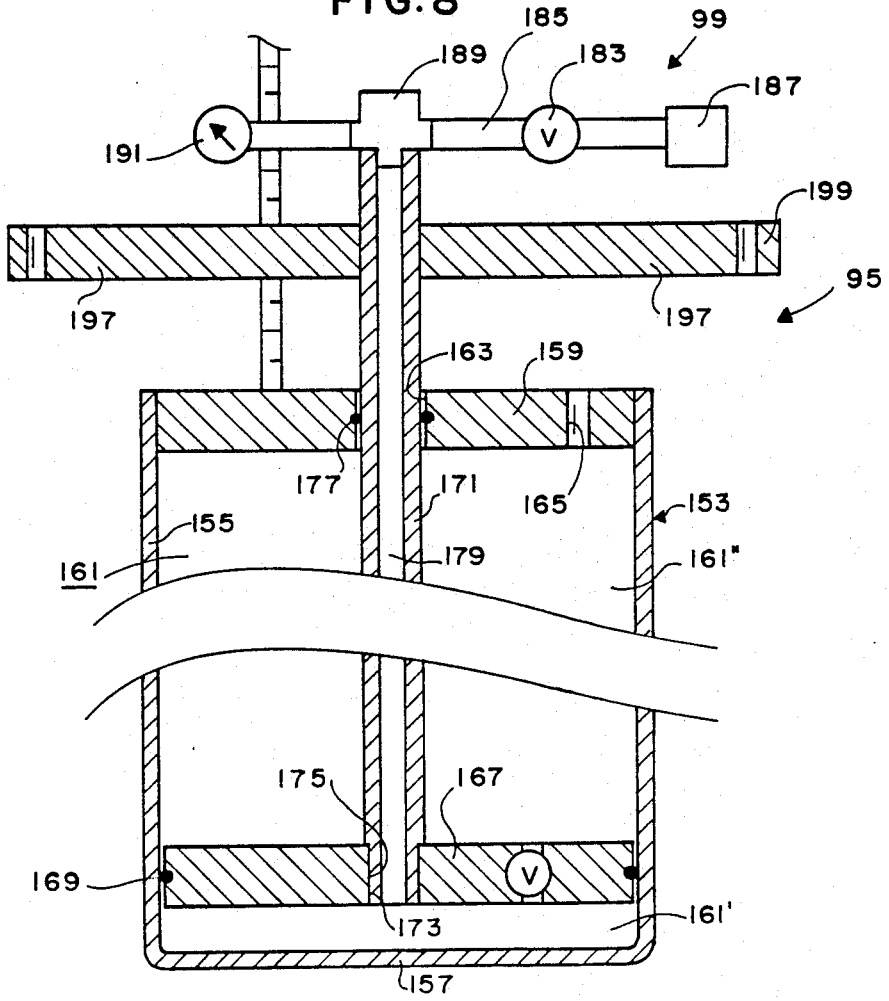
FIG. 8 is an enlarged sectional view taken as on the line VIII—VIII of FIG. 7.
Figure 10:
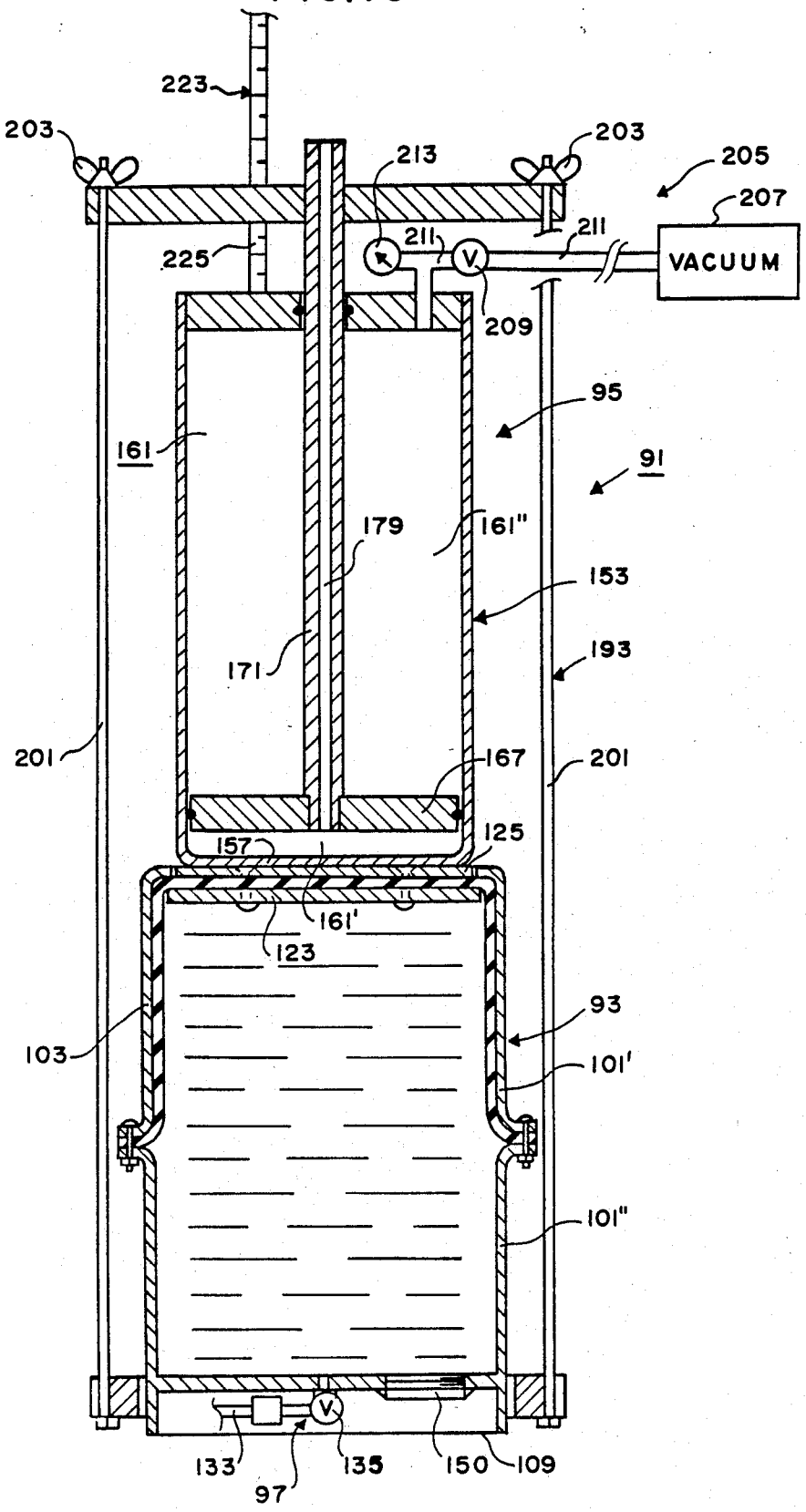
FIG. 10 is a view similar to FIG. 9 but showing the apparatus arranged for the use of a vacuum rather than compressed air and with the parts thereof in an extended position.

Additionally, container 93 includes a first plate 123, which is preferably disk-like and is disposed under the greater part of the end 119 of diaphragm 113, a second plate 125, which is also preferably disk-like, is disposed on the top side or opposite side of diaphragm 113 from first plate 123 with the end 119 of diaphragm 113 being sandwiched between plates 123, 125, and means well known to those skilled in the art, such as rivets 127, fixedly join together plates 123, 125 with the portion of end 119 therebetween and with this joint being sealed against leakage of liquid L from the container 93. Second plate 125 is of a smaller size than opening 111 whereby second plate 125 is adapted to freely extend into opening 111, as best seen in FIG. 5. First plate 123 is of a larger size than opening 111 whereby the end 105 of housing 101 is adapted to act as a stop to limit movement of plates 123, 125 and the sandwiched portion of end 119 of diaphragm 113, as best seen in FIGS. 5 and 10, wherein diaphragm 113 is in an extended position in which container 93 can hold its greatest capacity of liquid L. It will be understood from the foregoing that plates 123, 125 establish part of a movable portion 128 of container 93 which is movable relative to the fixed portions of container 93, i.e., the wall 103, end 105, and end 107, and that diaphragm 113 acts as a means for sealing the movable portion and the fixed portions of container 93 to permit movement of the movable portion and at the same time prevent liquid from escaping from between the movable portion and the fixed portion.

Discharge means 97 comprises quick coupling means 129 preferably like coupling means 55 and well known to those skilled in the art which is fixedly attached to end 107 and which is in communication with the interior of housing 101 and diaphragm 113 through an aperture 131. In addition, discharge means 97 includes conduit means 133 coupled to quick-coupling means 129 for conducting the dispensed liquid L to a place of use, and includes one-way check valve means 135 for permitting the discharge of liquid L, i.e. permitting the flow from container 93 through conduit means 133 when actuator means 95 is actuated to expell liquid L.

System 91 includes a removable shipping cover 137 for placement over end 105 of housing 101 and over the movable portion 128 of housing 101, as best seen in FIG. 5, to secure the container 93 during the shipping thereof. Shipping cover 137 is of suitable construction now known to those skilled in the art and preferably includes a plurality of projections 139 spaced around the periphery thereof. Also, a like plurality of projections 141 are preferably fixedly attached to the outside of housing 101 adjacent end 107 and beneath projections 139. A like plurality of coupling means 143 well known to those skilled in the art are provided, which include rods 145 and butterfly nuts 147, for quick attachment and detachment thereof. Also, for quick attachment and detachment, the projections 141 are each provided with an opening 149 for the rod 145 to enter and exit therefrom during the process of the attaching and detaching of the coupling means 143.

A sealable bung 150 is preferably removably provided in a threaded bung hole 151 in end 107 for filling container 93.

Actuator means 95 (see FIGS. 6–9) includes a projection 153 having a cylindrical wall 155, a first end 157 preferably integrally attached to wall 155 at one end of the wall, and a second end 159 fixedly attached to wall 155 by suitable means well known to those skilled in the art at the opposite end of the wall to define an enclosed projection chamber 161. Second end 159 is provided with a central opening 163 and another opening 165 therethrough.

Force transmitting means 99 includes a piston 167 movably mounted in projection chamber 161 to divide the projection chamber into a variable volume first chamber 161' below piston 167 and a second chamber 161" above piston 167. Piston 167 is sealably and slidably mounted to the interior surface of wall 153 by O-ring 169 which isolates chambers 161' and 161" from one another.

Force transmitting means 99 also includes a rod 171 having the lower end 173 extending through a central opening 175 in piston 167 and fixedly attached to the piston by suitable means well known to those skilled in the art. Rod 171 extends upwardly from its lower end 173 movably through opening 163 to the outside of projection 155. O-ring 177 forms a seal between rod 171 and second end 159.

Force transmitting means 99 additionally preferably includes the use of air pressure as shown in FIGS. 6–9 or if desired vacuum may be utilized as shown in FIG. 10. It will be understood that the system 91 of the second embodiment is arranged so that either air pressure or vacuum can be utilized as the user desires.

Referring first to the system as set up for air pressure (FIGS. 6–9), rod 171 has a channel 179 extending along the length of rod 171 and communicating at the lower end of the channel with first chamber 161' and at the upper end of the channel is provide air pressure means 181 communicating with channel 179 for delivering air under pressure to first chamber 161'. Air pressure means 181 is of any suitable construction well known to those skilled in the art to preferably provide a constant pressure of air through the valve 183 that is interposed in a conduit 185, which is communicated at one end with an air pressure source 187 and at the other end with channel 179 through the coupling 189. An air pressure gauge 191 is preferably provided to indicate the air pressure. All of the above components of air pressure means 181, including valve 183, conduit 185, air pressure source 187, coupling 189, and air pressure gauge 191 are well known to those skilled in the art. If desired, air pressure source 187 can be a lightweight portable air pressure source, such as an air pressure tank or an air pressure pump, etc. well known to those skilled in the art.

Figure 9:
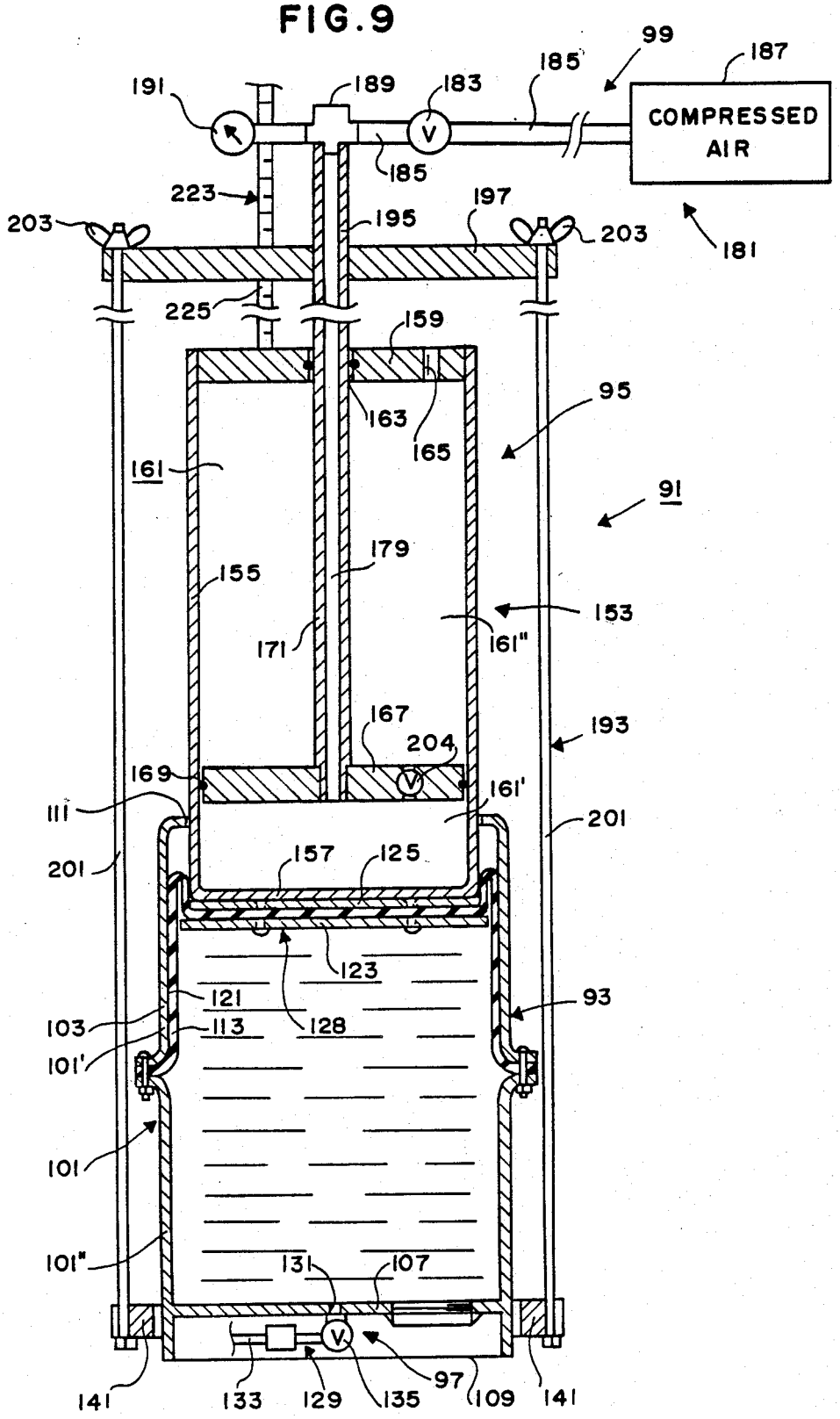
FIG. 9 is a partially sectionalized view along a vertical plane through the center of the system of said second embodiment with the actuator and container thereof shown in an assembled relationship and the parts in one of the retracted positions.

FIG. 9 shows the actuator means 95 and force transmitting means 99 of FIGS. 6–9 assembled with container 93 for use, wherein it will be seen the shipping coupling means 143 and shipping cover 137 have been removed and actuator means 95 has been coupled to movable portion 128 by placing the first end 157 of projection 153 on top of second plate 125.

First coupling means 193 is attached to rod 171 adjacent the upper end 195 of rod 171 and attached to container 93 adjacent end 107 of container 93 for holding container 93, rod 171 and piston 167 fixed against relative movement away from one another as the system is operated, which will be better understood in the description to follow hereinafter.

First coupling means 193 preferably includes a plurality of brackets 197 fixedly attached adjacent the inner ends thereof to rod 171 and extending radially outwardly therefrom, projections 199 (similar to projections 139) respectively fixedly attached to the outer ends of brackets 197, elongated rods 201, and butterfly nuts 203, all of which operate in conjunction with projections 141 in a manner similar to shipping coupling means 143.

Normally when the operation of the system 91 is first begun, diaphragm 113 is in an extended position in which container 93 can hold more of the liquid as a capacity as shown in FIG. 5. It also will be understood when the parts are being assembled, the one-way valve means 135 is in a closed condition. Then at the beginning of the operation of the system 91, shown in FIG. 9, with projection 153 in a normally completely retracted or first position (i.e., with piston 167 adjacent first end 157), valve 183 is opened to give the desire amount of air pressure which then enters first chamber 161' through channel 179 to cause relative movement of projection 153 and piston 167 from said first position towards the second position in which piston 167 is adjacent second end 169. In other words, the projection 153 is moved downwardly to extend actuator means 95 and move diaphragm 113 from said extended position to retracted positions, one of which is shown in FIG. 9. This forces the liquid L out through discharge means 97. It will be understood that when the movable portion 128 of container 93 (i.e. plates 123, 125 and portions of diaphragm 113) moves downwardly into the lower half 101" of housing 101, the side wall 121 of diaphragm 113 will move downwardly against the interior surface of housing half 101". Then, when the movable portion 128 reaches a point adjacent or in contact with end 107, liquid L will be substantially completely emptied from the interior of container 93.

A relief valve 204 is preferably provided in piston 167 between chambers 161' and 161", which normally does not allow air to pass from chamber 161' to chamber 161" when air pressure means 181 is used except when the pressure exceeds a given maximum amount in chamber 161' in which case the refief valve acts as a safety valve and allows air to pass to chamber 161" and out opening 165.

To use the system with a vacuum, as shown in FIG. 10, air pressure means 181 is removed and vacuum means 205 is installed and communicated with second chamber 161" through the opening 165. Vacuum means 205 preferably includes a vacuum source 207, a valve 209 interposed in conduit 211, and a gauge 213 for indicating the amount of vacuum, all of which are well known to those skilled in the art.

System 91 preferably includes suitable measuring means 223, which will not be apparent to those skilled in the art, for indicating the position of projection 153 and container 93 relative to one another. Thus, for example, measuring means 223 may simply include an upstanding measuring rod 225 attached at the lower end thereof to second end 159 of projection 153 having graduations such as graduations 85 of measuring means 79 and having a suitable pointer, not shown, well known to those skilled in the art adjacent measuring rod 225 and attached to one of the brackets 197 for indicating the amount of liquid L displaced from container 93 by projection 153.

In the operation of the system 91 of the present invention, it is particularly useful to contain, transport and/or dispense liquids such as those used for spraying crops on a field of a farm. Thus, container 93 may be filled through the bung hole 151 by the chemical manufacturer at its plant. Then, with the one-way valve means 135 closed off and shipping cover 137 and coupling means 143 in place, the container 93 may be transported to the farm where the farmer who keeps the actuator means 95 at his farm, can then remove coupling means 143 and cover 137, connect quick coupling 129, and then place the projection 153 on top of the container 93, attach the air pressure means 181 or the vacuum means 205, and dispense the desired amount of chemicals through the conduit means 133 by activating the pressure means 181 or vacuum means 205 while monitoring the amount dispensed by means of the measuring means 223. After the container 93 is empty, the farmer can then return the empty container 93 to the chemical manufacturer for a refill and keep the actuator means 95 for subsequent use.

Figure 11:
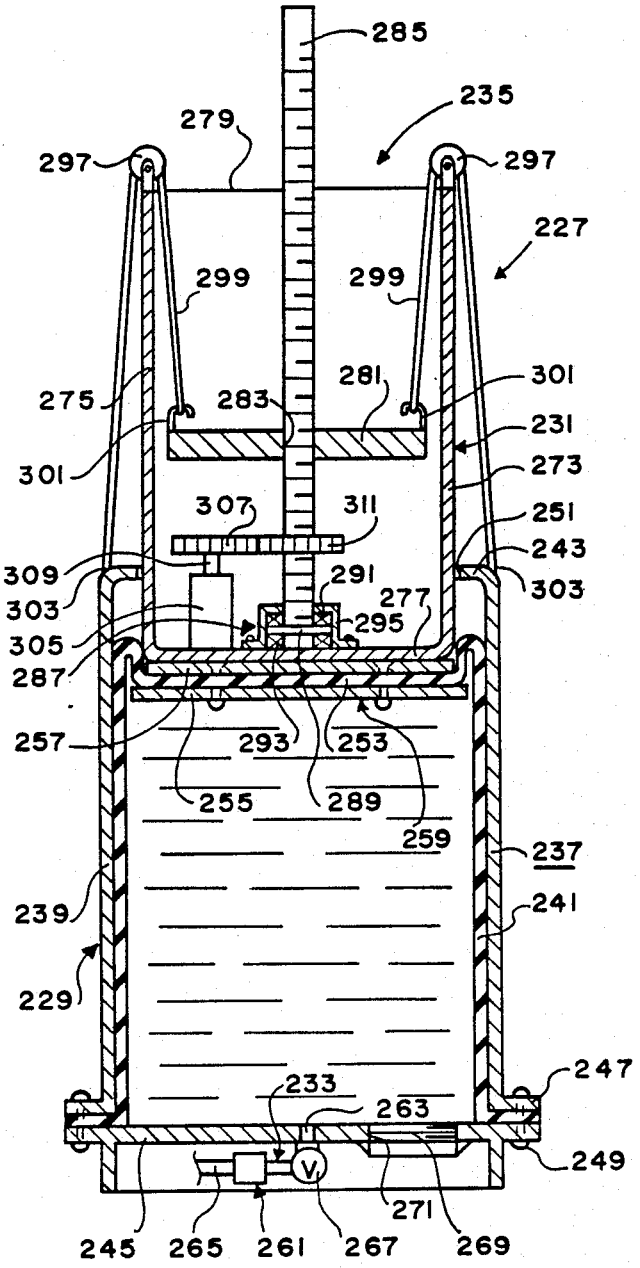
FIG. 11 is a partially sectionalized view along a vertical plane through the center of a modified system of the present invention in which the force transmitting means includes a motor.

A modified system 227 of the present invention is shown in FIG. 11. System 227 includes in general, a container 229 for the liquid L, actuator means 231, discharge means 233, and force transmitting means 235.

Container 229 is similar in construction to container 93 of system 91 and includes a hollow cylindrical housing 237 having a cylindrical side wall 239 which may be of two piece construction with two halves like container 93 with the diaphragm being like diaphragm 113 covering only one half of the interior surface of wall 239 or may cover the entire wall 239 as does the diaphragm 241, as shown in FIG. 11. Hollow cylindrical housing 237 includes an end 243 having the outer peripheral edge thereof preferably integrally attached to the upper edge of wall 239, and an end 245 spaced from end 243 having the outer peripheral edge thereof attached adjacent to the lower edge of wall 239 by suitable means as the flange 247 and bolt means 249 with the lower end of diaphragm 241 being sandwiched between the peripheral edge of end 245 and flange 247. End 243 has an opening 251, which is preferably circular with the center thereof preferably being along the center line of the housing 237.

Flexible diaphragm 241 is well known to those skilled in the art and is preferably of the so-called "rolling type" and which is formed of any suitable material such as rubber, plastic or the like. Diaphragm 241 is closed at the upper end 253 thereof.

Additionally, container 229 includes a first plate 255 and a second plate 257 which are attached to end 253 of diaphragm 241 in the same manner as plates 123 and 125 of system 91 are attached to end 119 of diaphragm 113. Plates 255 and 257 establish part of a movable portion 259 of container 229 which is movable relative to the fixed portion 260 of container 229, i.e., the wall 239, end 243, and end 245, and diaphragm 241 acts as a means for sealing the movable portion and the fixed portion of container 229 to permit movement of the movable portion and at the same time prevent liquid from escaping from between the movable portion and the fixed portion.

Discharge means 233 comprises quick coupling means 261 preferably like coupling means 55 and well known to those skilled in the art which is fixedly attached to end 245 and which is in communication with the interior of housing 237 and diaphragm 241 through an aperture 263. In addition, discharge means 233 includes conduit means 265 coupled to quick-coupling means 261 for conducting the dispensed liquid L to a place of use, and includes one-way valve check valve means 267 for permitting the discharge of liquid L, i.e. permitting the flow from container 229 through conduit means 265 when actuator means 231 is actuated. A sealable bung 269 is preferably removably provided in a threaded bung hole 271 in end 245 for filling container 229.

Actuactor means 231 includes a projection 273 having a cylindrical wall 275, a lower end 277 preferably integrally attached to wall 275 at the lower end of the wall, and an open upper end 279. Lower end 277 rests on top of movable portion 259 of housing 237.

Force transmitting means 235 includes a disc-like plate 281 having a threaded aperture 283 extending vertically through the center thereof and a threaded vertical shaft 285 threadedly extending through aperture 283. A coupler 287 couples shaft 285 adjacent the lower end thereof to lower end 277 for rotatably supporting shaft 285 from projection 273. Coupler 287 preferably includes a circular flange 289 fixedly mounted on shaft 285 which is disposed between two bearing rings 291, 293, that are held in a casing 295 anchored to lower end 277 adjacent the central portion of the inside surface of end 277 by suitable means well known to those skilled in the art, so that shaft 285 can rotate and yet is held against vertical movement relative to projection 273.

Additionally, force transmitting means 235 includes a pair of pulleys 297 mounted on projection 273 adjacent the upper end of the projection, and a pair of flexible elongated pull lines 299 which respectively extend through pulleys 297. One end of each of the pull lines 299 is fixed to disc-like plate 281 by suitable means known to those skilled in the art, such as hooks 301 and the opposite end of each of the pull lines 299 is anchored, as at 303 by suitable means known to those skilled in the art, to housing 237 adjacent the end 243 thereof.

In addition, force transmitting means 235 includes a motor 305, powered electrically or by any other suitable means having suitable conduits, wiring, switches or the like, not shown, all of which now are well known to those skilled in the art. Motor 305 is preferably fixedly mounted inside of projection 273 on end 277 thereof by any suitable known means. Also, force transmitting 235 includes a first gear 307 fixedly mounted on shaft 309 of motor 305 which meshes with a second gear 311 fixedly mounted on 285.

In the operation of system 227 it will be understood that when motor 305 is turned on it causes shaft 285 to rotate which in turn causes disc-like plate 281 to move towards lower end 277 to pull elongated pull lines 299 and draw projection 273 downwardly against movable portion 259 of container 229 and move movable portion 259 downwardly towards retracted positions to cause liquid L to be discharged from container 229.

Figure 12:
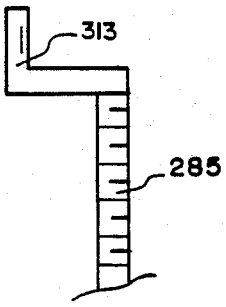
FIG. 12 is another modification of the system of FIG. 11 in which the force transmitting means includes a hand crank in place of the motor.

A modification of system 227 is shown in FIG. 12, wherein it will be seen that in place of motor 305 and gears 307 and 311, a hand crank 313 is attached to shaft 285 adjacent the upper end of the shaft for causing rotation of the shaft to move disc-like plate 281 towards lower end 277 to pull elongated pull lines 299 and draw projection 273 downwardly against movable portion 259 of container 229 and move movable portion 259 downwardly towards retracted positions to cause liquid L to be discharged from container 229.

Also, it will be understood that the systems 11, 91, and 227 of the present invention are absolutely closed systems, whereby hazardous chemicals can be shipped, dispensed, and refilled without the user having to come in contact with such chemicals, and in which the pump and meter of previous systems are eliminated.

In addition, it will be understood that with the systems 11, 91 and 227 of the present invention, an extremely accurate measurement of the amount of liquid being used can be obtained since the measuring is done by a known factor, that is, the displacement of the liquid in each container 13, 93, and 227 is by a known volume of the projections 69, 153, and 273. This is in contrast to prior measuring devices in which the measurement is not on a known volume displacement basis. Also, the containers 13, 93, and 227 can be filled with no air spaces therein which is in contrast to many of the prior measuring devices in which the presence of pockets of air distorts the readings of the measuring devices.

Although the present invention has been described and illustrated with respect to a preferred embodiment, a second embodiment, and a third embodiment, and the preferred use thereof, it is not to be so limited since changes and modifications can be made therein which are within the full intended scope of the invention.

I claim:

1. A system for selectively containing and dispensing liquid comprising:

(a) a container for liquid, said container including a housing having an interior and an opening in one end thereof and being open at the opposite end thereof, said housing including a flange at the edge thereof adjacent the open end thereof, a cover, means for removably mounting said cover means over the open end of said housing, a flexible diaphragm means in said interior of said housing for holding the liquid, said diaphragm means being provided with a flange at an edge thereof, said flange of said diaphragm means being sandwiched between said cover means and said flange of said housing to hold said edge of said diaphragm in place, and said diaphragm means being unattached to said housing along the sides of said housing;

(b) actuator means coupled to said diaphragm means for moving said diapahragm means between an extended position in which said diaphragm means can hold more of the liquid to a completely retracted position in which said diaphragm means holds less of the liquid than when in said extended position, said actuator means including a projection of a size adapted to extend through said opening in said one end of said housing, a first plate disposed over the end of said diaphragm means and a second plate disposed on the opposite side of said diaphragm means from said first plate, means joining said first and second plates together with the end of said diaphragm means being sandwiched therebetween, said second plate being of a smaller size than said opening in said one end of said housing whereby said second plate is adapted to extend into said opening, said first plate being of a larger size than said opening in said one end of said housing whereby the end of said housing is adapted to act as a stop to limit movement of said first and second plates and the end of said diaphragm means, said second plate being adapted to contact said projection whereby relative movement of said container and said projection towards one another into said completely retracted position is effective to displace the liquid from the interior of said container, said container and said actuator means being separable from one another whereby said container can be filled and sealed with liquid at a location remote from said actuator means and then transported to the location of said actuator means for joining with said actuator means to dispense the liquid from said container;

(c) discharge means comprising quick coupling means including a first part fixedly attached to said cover means and in communication with the interior of said housing and said diaphragm means and including a second part detachably connected to said first part and in communication with said first part and thereby in communication with the interior of said housing and said diaphragm means and conduit means coupled to said second part for conducting the expelled liquid to a place of use, and said discharge means including valve means for controlling the discharge of the liquid; and (d) force transmitting means coupled to said actuator means for causing said actuator means to move said diaphragm means in a direction from said extended position towards said completely retracted position to dispense the liquid from said container and out said discharge means.

2. A system for selectively containing and dispensing liquid comprising:

(a) a container for the liquid, said container including a housing having an interior, said housing including a fixed portion and a movable portion movable relative to said fixed portion, means sealing said movable portion and said fixed portion for permitting movement of said movable portion and at the same time for preventing liquid from escaping from between said movable portion and said fixed portion;

(b) actuator means coupled to said movable portion for moving said movable portion between an extended position in which said container can hold more of the liquid and retracted positions in which said container holds less of the liquid than when in said extended position, said actuator means including a projection having a cylindrical wall, a first end attached to said wall at one end of said wall and a second end attached to said wall at the opposite end of said wall to define an enclosed projection chamber, said second end having an opening centrally thereof;

(c) discharge means communicated with the interior of said housing for discharging the liquid held in said container to the exterior of said container, said discharge means including valve means for controlling the discharge of the liquid; and (d) force transmitting means coupled to said actuator means for causing said actuator means to move said movable portion in a direction from said extended position towards said retracted positions to displace and dispense the liquid from said container and out said discharge means, said force transmitting means including a piston mounted in said projection chamber to divide said projection chamber into a variable volume first chamber and variable volume second chamber and for relative movement of said projection and said piston between a first position in which said piston is adjacent said first end of said projection and a second position in which said piston is adjacent said second end of said projection, a rod fixedly attached at one end thereof to said piston and the other end of said rod extending upwardly through said opening in said second end to the outside of said projection, said rod having a channel extending along the length of said rod and communicating with said first chamber, and air pressure means communicating with said channel for delivering air under pressure to said first chamber to cause said container and said projection to move relatively towards one another into a retracted postion and displace the liquid from the interior of said container; and including first coupling means attached to said rod adjacent said other end of said rod and attached to said container adjacent one end of said container for holding said container, said rod, and said piston fixed relative to one another.

3. A system for selectively containing and dispensing liquid comprising:

(a) a container for the liquid, said container including a housing having an interior, said housing including a fixed portion and a movable portion movable relative to said fixed portion, means sealing said movable portion and said fixed portion for permitting movement of said movable portion and at the same time for preventing liquid from escaping from between said movable portion and said fixed portion;

(b) actuator means coupled to said movable portion for moving said movable portion between an extended position in which said container can hold more of the liquid and retracted positions in which said container holds less of the liquid than when in said extended position, said actuator means including a projection having a cylindrical wall, a lower end attached to said wall adjacent the lower end of said wall, and an open end;

(c) discharge means communicated with the interior of said housing for discharging the liquid held in said container to the exterior of said container, said discharge means including valve means for controlling the discharge of the liquid; and (d) force transmitting means coupled to said actuator means for causing said actuator means to move said movable portion in a direction from said extended position towards said retracted positions to displace and dispense the liquid from said container and out said discharge means, said force transmitting means including a disc-like plate having a threaded aperture extending vertically through the center thereof, a threaded vertical shaft threadedly extending through said vertical aperture, means coupling said vertical shaft adjacent the lower end thereof to said first end for rotatably supporting said shaft from said projection, pulley means mounted on said projection adjacent the upper end of said projection, flexible elongated pull means extending through said pulley means and fixed respectively to said disc-like means and said container at the opposite ends thereof, motor means mounted on said first end, said motor means including a rotatable drive shaft, means coupling said drive shaft to said threaded vertical shaft for causing rotation of said threaded vertical shaft by said motor means to move said disc-like plate towards said lower end of said projection to pull said elongated pull means and draw said projection downwardly against said movable portion of said container and move said movable portion towards said retracted positions.

4. A system for selectively containing and dispensing liquid comprising:

(a) a container for the liquid, said container including a housing having an interior, said housing including a fixed portion and a movable portion movable relative to said fixed portion, means sealing said movable portion and said fixed portion for permitting movement of said movable portion and at the same time for preventing liquid from escaping from between said movable portion and said fixed portion;

(b) actuator means coupled to said movable portion for moving said movable portion between an extended position in which said container can hold more of the liquid and retracted positions in which said container holds less of the liquid than when in said extended position, said actuator means including a projection having a cylindrical wall, a first end attached to said wall adjacent the lower end thereof, and an open upper end;

(c) discharge means communicated with the interior of said housing for discharging the liquid held in said container to the exterior of said container, said discharge means including valve means for controlling the distance of the liquid; and (d) force transmitting means coupled to said actuator means for causing said actuator means to move said movable portion in a direction from said extended position towards said retracted positions to displace and dispense the liquid from said container and out said discharge means, said force transmitting means including a disc-like plate having a threaded aperture extending vertically through the center thereof, a threaded vertical shaft threadedly extending through said vertical aperture, means coupling said vertical shaft adjacent the lower end thereof to said first end for rotatably supporting said shaft from said projection, pulley means mounted on said projection adjacent the upper end of said projection, flexible elongated pull means extending through said pulley means and fixed respectively to said disc-like means and said container at the opposite ends thereof, and hand crank means attached to said shaft adjacent the upper end thereof for causing rotation of said shaft by said hand crank means to move said disc-like plate towards said lower end of said projection to pull said elongated pull means and draw said projection downwardly against said movable portion of said container and move said movable portion towards said retracted positions.

5. A system for selectively containing and dispensing liquid comprising:

(a) a container for the liquid, said container including a housing having an interior, and a flexible diaphragm means in said interior of said housing for holding the liquid, said container including a pair of ends with one of said ends having an opening therein extending from the interior of said housing to the exterior thereof and the other end being spaced from said one of said ends, said diaphragm means sealing said opening against passage of fluid therethrough from the interior to the exterior of said container;

(b) actuator means coupled to said diaphragm means for moving said diaphragm means between an extended position in which said diaphragm means can hold more of the liquid and retracted positions in which said diaphragm means holds less of the liquid than when in said extended position, said actuator means including a projection of a size adapted to extend through said opening, a first plate disposed at the end of said diaphragm means and a second plate disposed on the opposite side of said diaphragm means from said first plate, means joining said first and second plates together with the end of said diaphragm means being sandwiched therebetween, and said second plate being adapted to contact said projection whereby relative movement of said container and said projection towards one another into a retracted position is effective to displace the liquid from the interior of said container;

(c) discharge means communicated with the interior of said housing at a place remote from said projection for discharging the liquid held in said diaphragm means to the exterior of said container, said discharge means including valve means for controlling the discharge of the liquid; and (d) force transmitting means coupled to said actuator means for causing said actuator means to move said diaphragm means in a direction from said extended position towards said retracted positions to dispense the liquid from said container and out said discharge means.

6. The system of claim 5 in which said diaphragm means substantially completely empties the interior of said housing of the liquid therein when said diaphragm is in a completely retracted position wherein said first plate is adjacent said other end of said container and when said diaphragm means is in said extended position, the interior of said housing is at a maximum capacity for holding the liquid therein.

7. A system for selectively containing and dispensing liquid comprising:

(a) a container for the liquid, said container including a housing having an interior, said housing including a fixed portion and a movable portion movable relative to said fixed portion, means sealing said movable portion and said fixed portion for permitting movement of said movable portion and at the same time for preventing liquid from escaping from between said movable portion and said fixed portion;

(b) actuator means coupled to said movable portion for moving said movable portion between an extended position in which said container can hold more of the liquid and retracted positions in which said container holds less of the liquid than when in said extended position, said actuator means including a projection having a cylindrical wall, a first end attached to said wall at one end of said wall and a second end attached to said wall at the opposite end of said wall to define an enclosed projection chamber, said second end having an opening centrally thereof;

(c) discharge means communicated with the interior of said housing for discharging the liquid held in said container to the exterior of said container, said discharge means including valve means for controlling the discharge of the liquid; and (d) force transmitting means coupled to said actuator means for causing said actuator means to move said movable portion in a direction from said extended position towards said retracted positions to displace and dispense the liquid from said container and out said discharge means, said force transmitting means including a piston movably mounted in said projection chamber to divide said projection chamber into a variable volume first chamber and variable volume second chamber and for relative movement of said projection and said piston between a first position in which said piston is adjacent said first end of said projection and a second position in which said pisiton is adjacent said second end of said projection, a rod fixedly attached at one end thereof to said piston and the other end of said rod extending upwardly through said opening in said second end to the outside of said projection, and vacuum means communicating with said second chamber for causing said container and said projection to move relatively towards one another into a retracted postion and displace the liquid from the interior of said container; and (e) first coupling means attached to said rod adjacent said other end of said rod and attached to said container adjacent one end of said container for holding said container, said rod, and said piston fixed against relative movement away from one another.

8. The system of claim 7 wherein said first coupling means includes quick detachable means for detaching said rod from said container to allow separation of said container from said force transmitting means.

9. A system for selectively containing and dispensing liquid comprising:

(a) a container for the liquid, said container including a housing having an interior, a flexible diaphragm means in said interior of said housing for holding the liquid, and an opening in one end of said housing extending from the interior of said housing to the exterior thereof;

(b) actuator means coupled to said diaphragm means, said actuator means being exteriorly of said housing and including projection means of a size adapted to extend through said opening from the exterior of said housing to the interior thereof for moving said diaphragm means between an extended position in which said diaphragm means can hold more of the liquid and retracted positions in which said diaphragm means holds less of the liquid than when in said extended position;

(c) discharge means communicated with the interior of said housing remote from said opening for discharging the liquid held in said diaphragm means to the exterior of said container, said discharge means including valve means for controlling the discharge of the liquid; and (d) force transmitting means exteriorly of said housing coupled to said actuator means for causing said actuator means to move said diaphragm means in a direction from said extended position towards said retracted positions to dispense the liquid from said container and out said discharge means.

10. The system of claim 9 in which said actuator means and said container are separable from one another whereby said container can be filled with liquid at a location remote from said actuator means and then transported to the location of said actuator means for joining with said actuator means to dispense the liquid from said container.

11. The system of claim 9 which includes measuring means for measuring the amount of liquid dispensed from said discharge means.

12. The system of claim 11 wherein said measuring means includes a measuring stick fixed relative to said actuator means and a pointer fixed relative to said container and movable with said container to indicate in conjunction with said measuring stick the relative positions of said actuator means and said container and the amount of liquid dispensed from said diaphragm means by said actuator means.

13. A system for selectively containing and dispensing liquid comprising:

(a) a container for the liquid, said container including a housing having an interior, said housing including a fixed portion and a movable portion movable relative to said fixed portion, said movable portion including means for holding the liquid, an opening in one end of said housing extending from the interior of said housing to the exterior thereof, said means for holding the liquid including means sealing said movable portion and said fixed portion for permitting movement of said movable portion and at the same time for preventing liquid from escaping to the exterior of said housing from between said movable portion and said fixed portion;

(b) actuator means coupled to said movable portion, said actuator means being exteriorly of said housing and including projection means of a size adapted to extend through said opening from the exterior of said housing to the interior thereof for moving said movable portion between an extended position in which said container can hold more of the liquid and retracted positions in which said container can hold less of the liquid than when in said extended position;

(c) discharge means communicated with the interior of said housing remote from said opening for discharging the liquid held in said container to the exterior of said container, said discharge means including valve means for controlling the discharge of the liquid; and (d) force transmitting means exteriorly of said housing coupled to said actuator means for causing said actuator means to move said movable portion in a direction from said extended position towards said retracted positions to displace and dispense the liquid from said container and out said discharge means.

14. The system of claim 13 wherein said sealing means includes flexible diaphragm means.

15. The system of claim 13 which includes measuring means for measuring the amount of liquid dispensed from said discharge means, said measuring means including means for measuring the relative positions of said actuator means and said container, the amount of liquid displaced by said projection, and the amount of liquid displaced and dispensed from said container by said actuator means.

16. The system of claim 13 which includes shipping cover means for placement over said movable portion, and shipping coupling means removably coupling said shipping cover means and said container.

17. The system of claim 13 wherein said force transmitting means includes motor means.

18. The system of claim 13 wherein said force transmitting means includes hand crank means.

19. A system for selectively containing and dispensing liquid comprising:

(a) a container for the liquid, said container including a housing having an interior, and a flexible diaphragm means in said interior of said housing for holding the liquid, said container having an opening in one end thereof and having an open end at the opposite end thereof;

(b) actuator means coupled to said diaphragm means for moving said diaphragm means between an extended position in which said diaphragm means can hold more of the liquid and retracted positions in which said diaphragm means holds less of the liquid than when in said extended position, said actuator means including a projection of a size adapted to extend through said opening;

(c) a first plate disposed over the end of said diaphragm means and a second plate disposed on the opposite side of said diaphragm means from said first plate, means joining said first and second plates together with the end of said diaphragm means being sandwiched therebetween, said second plate being of a smaller size than said opening whereby said second plate is adapted to extend into said opening, said first plate being of a larger size than said opening whereby the end of said housing is adapted to act as a stop to limit movement of said first and second plates and the end of said diaphragm means in an expanded condition, said second plate being adapted to contact said projection whereby relative movement of said container and said projection towards one another into a retracted position is effective to displace the liquid from the interior of said container;

(d) discharge means communicated with the interior of said housing for discharging the liquid held in said diaphragm means to the exterior of said container, said discharge means including valve means for controlling the discharge of the liquid; and (e) force transmitting means coupled to said actuator means for causing said actuator means to move said diaphragm means in a direction from said extended position towards said retracted positions to dispense the liquid from said container and out said discharge means.

20. The system of claim 19 wherein said flexible diaphragm means is provided with a flange at the edge thereof, said housing is provided with a flange at the edge thereof, said container includes cover means and means for removably mounting said cover means over said open end of said housing, said flange of said diaphragm being sandwiched between said cover means and said flange of said housing to hold the edge of said diaphragm in place, and said diaphragm being unattached to said housing along the sides of said housing.

21. The system of claim 20 in which said diaphragm means substantially completely empties the interior of said housing of the liquid therein when said diaphragm is in a completely retracted position wherein said first plate is adjcent said cover means and when said diaphragm means is in said extended position, the interior of said housing is at a maximum capacity for holding the liquid therein.

22. The system of claim 21 wherein said actuator means includes a base for contacting a supporting surface, said base being attached to said projection with said projection extending upwardly therefrom.

23. The system of claim 20 wherein said discharge means comprises quick coupling means including a first part fixedly attached to said cover means and in communication with the interior of said housing and said diaphragm means and including a second part detachably connected to said first part and in communication with said first part and thereby in communication with the interior of said housing and diaphragm means, and conduit means coupled to said second part for conducting the dispensed liquid to a place of use.

24. The system of claim 23 wherein said force transmitting means includes biasing means coupled at one end to said container and at the other end to said actuator means for urging said actuating means towards said cover means, and the coupling of at least one of said ends of said biasing means being detachable.

25. The system of claim 23 wherein said force transmitting means includes biasing means coupled at one end to said container and at the other end to said actuator means for urging said actuating means towards said cover means, and the coupling of at least one of said ends of said biasing means being detachable.

26. The system of claim 25 which includes measuring means for measuring the amount of liquid dispensed from said discharge means, said measureing means including a measuring stick fixed relative to said actuator means and a pointer fixed relative to said container and movable with said container to indicate in conjunction with said measuring stick the relative positions of said actuator means and said container, the amount of liquid displaced by said projection, and the amount of liquid dispensed from said diaphragm means by said actuator means.

* * * * *